United States Patent [19]

Tsuchihashi et al.

[11] 4,120,026

[45] Oct. 10, 1978

[54] METHOD OF MIXED ILLUMINATION

[75] Inventors: Michihiro Tsuchihashi; Masato Saito; Makoto Yamanoshita, all of Amagasaki; Hidetoshi Katsura, Kamakura; Koichiro Maeyama, Kamakura; Yasushi Uchida, Kamakura; Osamu Myodo, Kamakura, all of Japan

[73] Assignee: Mitsubishi Denki Kabushiki Kaisha, Tokyo, Japan

[21] Appl. No.: 715,653

[22] Filed: Aug. 19, 1976

[30] Foreign Application Priority Data

Aug. 21, 1975 [JP] Japan ..... 50/101482

[51] Int. Cl.[2] ..... F21V 9/01

[52] U.S. Cl. ..... 362/231; 362/1; 362/458

[58] Field of Search ..... 240/1 R, 1.3, 2 C, 41 R, 240/41.1, 51.11 R, 20, 3.1

[56] References Cited

U.S. PATENT DOCUMENTS

| | | | |
|---|---|---|---|
| 3,143,300 | 8/1964 | Way | 240/2 R X |
| 3,345,509 | 10/1967 | Dauser | 240/20 |
| 3,517,180 | 6/1970 | Semotan | 240/1.3 X |
| 3,733,480 | 5/1973 | Glenn | 240/1.3 X |

*Primary Examiner*—Richard L. Moses

*Attorney, Agent, or Firm*—Oblon, Fisher, Spivak, McClelland & Maier

[57] ABSTRACT

Beautifully and balanced colored shadows can be cast of an object by using a lamp for emitting colored light in the range yellow to red, a lamp for emitting green colored light and a lamp for emitting colored light in the range violet to blue to give intensity ratios of illumination in the ranges of $$0.05 \leqq I_R/(I_R + I_G + I_B) \leqq 0.85;$$

$$0.05 \leqq I_G/(I_R + I_G + I_B) \leqq 0.8; \text{ and}$$

$$0.02 \leqq I_B/(I_R + I_G + I_B) \leqq 0.8$$

wherein $I_R$ designates an intensity of illumination caused by irradiating with only the lamp in the R group the shadow of an object cast by both of the lights of the lamps in the G group and the B group; $I_G$ designates an intensity of illumination caused by irradiating with only the lamp in the G group the shadow of the object cast by both of the lights of the lamps in the R group and the B group and $I_B$ designates an intensity of illumination caused by irradiating with only the lamp in the B group the combination of the shadow of the object cast by the light of the lamp in the R group and the shadow of another object cast by the light of the lamp in the G group.

6 Claims, 2 Drawing Figures

METHOD OF MIXED ILLUMINATION

BACKGROUND OF THE INVENTION

The present invention relates to an improved method of mixed illumination by irradiating an opaque object with color lamps so as to impart beautifully colored shadows while maintaining the balance of intensities of illumination of the color lamps.

When an opaque object disposed in front of a white wall is illuminated by color lamps, colored shadows of the object are formed on the wall behind the substance.

When the light of a second color lamp is irradiated on a shadow of an object cast by a first color lamp, the shadow is colored depending upon the characteristic of the second color lamp.

When the shadow of an object cast by a first color lamp is illuminated by second and third color lamps, the color of the shadows is imparted by the mixed illumination given by the second and third color lamps.

Heretofore, the conditions for imparting beautiful shadows have not been known.

It has not been known how to consider the intensity ratios given by color lamps so as to impart beautifully and balancedly colored shadows.

SUMMARY OF THE INVENTION

It is an object of the present invention to provide a method of mixed illumination for casting beautifully and balancedly colored shadows from an object.

The object of the present invention can be attained by providing a method of mixed illumination by arranging color lamps in three R, G and B groups of at least one lamp for emitting colored light in the range yellow to red (R group); at least one lamp for green (G group) and at least one lamp for emitting colored light in the range violet to blue (B group) and irradiating opaque objects to cause colored shadows of the objects; to give the intensity ratios of illumination caused by the color lamps in the ranges of $$0.05 \leqq I_R/(I_R + I_G + I_B) \leqq 0.85;$$

$$0.05 \leqq I_G/(I_R + I_G + I_B) \leqq 0.8; \text{ and}$$

$$0.02 \leqq I_B/(I_R + I_G + I_B) \leqq 0.8$$

wherein $I_R$ designates an intensity of illumination caused by irradiating with only the lamp the R group in the shadow of an object cast by both of the lights of the lamps in the G group and the B group; $I_G$ designates an intensity of illumination caused by irradiating with only the lamp in the G group the shadow of the object cast by both of the lights of the lamps in the R group and the B group and $I_B$ designates an intensity of illumination cast by irradiating with only the lamp in the B group the combination of the shadow of the object cast by the light of the lamp in the R group and the shadow of another object cast by the light of the lamp in the G group.

DETAILED DESCRIPTION OF THE PREFERRED EMBODIMENTS

The color lamps in the R group include a yellow color lamp, an orange color lamp, a red color lamp, a high pressure sodium lamp, an orange metal halide lamp (sodium halide is added) and a red metal halide lamp (lithium halide is added), etc.

The color lamps in the G group include a green color lamp and a green metal halide lamp (thallium halide is added), etc.

The color lamps in the B group include a violet color lamp, a blue color lamp, a violet metal halide lamp (gallium halide is added) and a blue metal halide lamp (indium halide is added), etc.

Figure 1:
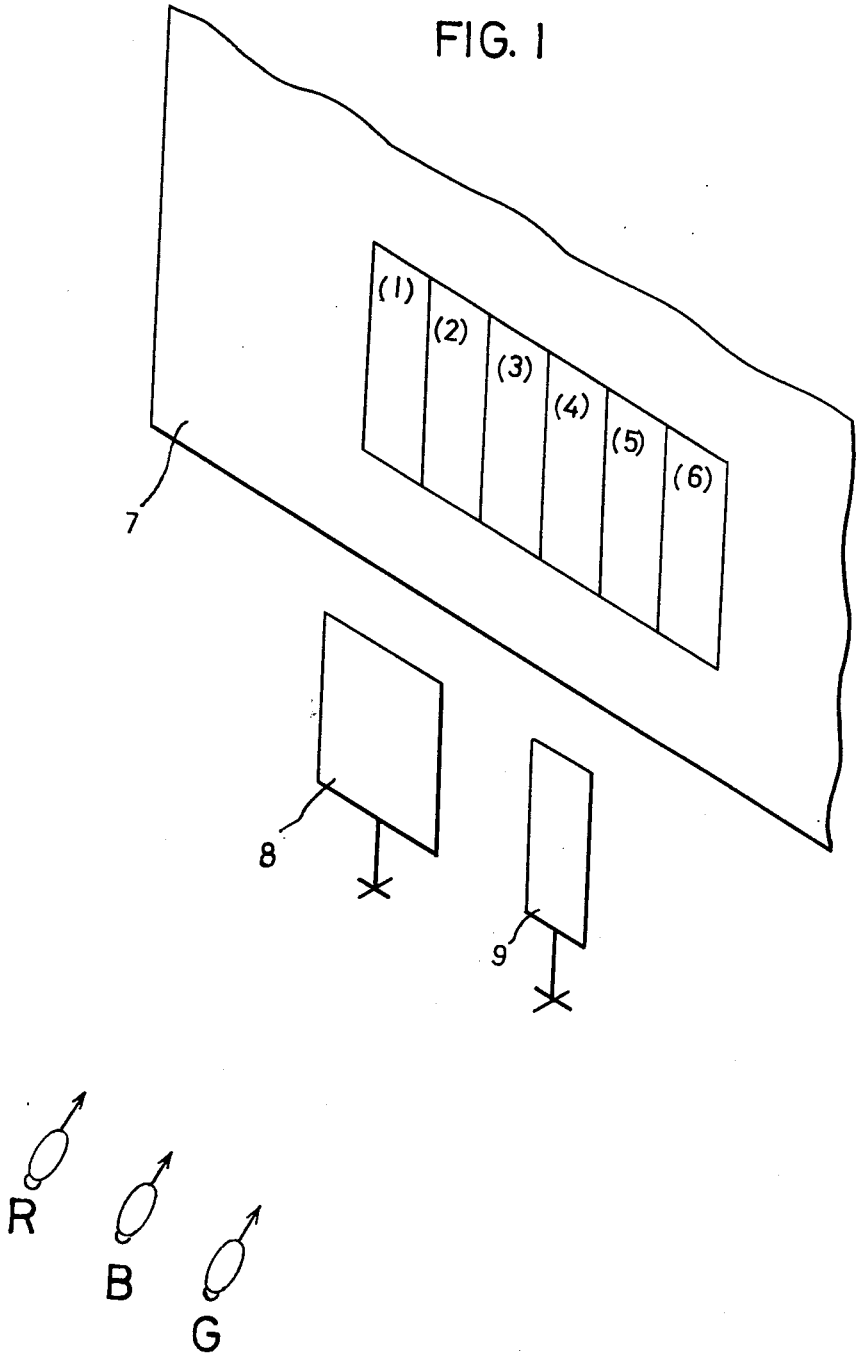
FIG. 1 is a schematic view of one embodiment of the method according to the invention.

FIG. 1 is a schematic view of one embodiment of the method of mixed illumination according to the present invention, to show colored shadows which are cast on a white wall by illuminating opaque objects 8, 9 disposed in front of the white wall 7 by using the high pressure sodium lamp as the lamp in the R group; the blue metal halide lamp (indium halide is added) as the lamp in the B group, and the green metal halide lamp (thallium halide is added) as the lamp in the G group.

On the wall, the shadow 1 is colored pink; the shadow 2 is colored orange; the shadow 3 is colored yellow; the shadow 4 is colored green; the shadow 5 is colored bluish green and the shadow 6 is colored blue.

The shadow 1 is the shadow of the object 8 cast by the light of the green metal halide lamp and it is colored pink by mixing therein the light of the high pressure sodium lamp and the light of the blue metal halide lamp.

The shadow 2 is the shadow of the object 8 cast by both of the lights of the blue metal halide lamp and the green metal halide lamp and is colored orange by the irradiation of the high pressure sodium lamp.

The shadow 3 is a shadow of the object 8 cast by the light of the blue metal halide lamp and is colored yellow by mixing therein the light of the high pressure sodium lamp and the green metal halide lamp.

The shadow 4 is a shadow of the object 8 cast by both of the lights of the high pressure sodium lamp and the blue metal halide lamp and is colored green by the irradiation of the green metal halide lamp.

The shadow 5 is a shadow of the object 8 cast by the light of the high pressure sodium lamp and is colored bluish green by mixing therein the light of the blue metal halide lamp and the light of the green metal halide lamp.

The shadow 6 is a shadow of the object 8 cast by the light of the high pressure sodium lamp and a shadow of the object 9 cast by the light of the green metal halide lamp and is colored blue by the irradiation of the blue metal halide lamp.

In the colored shadows on the wall, $I_R$ designates an intensity of illumination at the shadow 2 irradiated by only the high pressure sodium lamp in the R group; $I_G$ designates an intensity of illumination at the shadow 4 irradiated by only the green metal halide lamp in the G group; and $I_B$ designates an intensity of illumination at the shadow 6 irradiated by only the blue metal halide lamp in the B group.

The intensity ratios of $I_R$, $I_G$ and $I_B$ were respectively designated as $i_R$, $i_G$ and $i_B$.

The beauty and balance of the colored shadows were evaluated by rating A, B and C under changing the values of $i_R$, $i_G$ and $i_B$. The results are shown in Table 1.

TABLE 1

| Mark | $i_R$ | $i_G$ | $i_B$ | Rating* |
|---|---|---|---|---|
| 1 | 0.9 | 0.05 | 0.05 | C |
| 2 | 0.8 | 0.19 | 0.01 | C |
| 3 | 0.8 | 0.15 | 0.05 | B |
| 4 | 0.8 | 0.1 | 0.1 | B |
| 5 | 0.8 | 0.03 | 0.17 | C |
| 6 | 0.7 | 0.2 | 0.1 | B |
| 7 | 0.7 | 0.1 | 0.2 | B |
| 8 | 0.65 | 0.3 | 0.05 | B |
| 9 | 0.65 | 0.15 | 0.2 | B |
| 10 | 0.6 | 0.39 | 0.01 | C |
| 11 | 0.55 | 0.35 | 0.1 | A |
| 12 | 0.55 | 0.25 | 0.2 | A |
| 13 | 0.55 | 0.15 | 0.3 | B |
| 14 | 0.6 | 0.1 | 0.3 | B |
| 15 | 0.6 | 0.03 | 0.37 | C |
| 16 | 0.5 | 0.45 | 0.05 | A |
| 17 | 0.5 | 0.3 | 0.2 | A |
| 18 | 0.5 | 0.1 | 0.4 | B |
| 19 | 0.4 | 0.59 | 0.01 | C |
| 20 | 0.4 | 0.57 | 0.03 | B |
| 21 | 0.4 | 0.55 | 0.05 | A |
| 22 | 0.4 | 0.5 | 0.1 | A |
| 23 | 0.4 | 0.4 | 0.2 | A |
| 24 | 0.4 | 0.3 | 0.3 | A |
| 25 | 0.4 | 0.25 | 0.35 | A |
| 26 | 0.4 | 0.15 | 0.45 | B |
| 27 | 0.3 | 0.65 | 0.05 | B |
| 28 | 0.3 | 0.5 | 0.2 | A |
| 29 | 0.3 | 0.4 | 0.3 | A |
| 30 | 0.3 | 0.2 | 0.5 | B |
| 31 | 0.3 | 0.03 | 0.67 | C |
| 32 | 0.2 | 0.79 | 0.01 | C |
| 33 | 0.2 | 0.7 | 0.1 | B |
| 34 | 0.2 | 0.65 | 0.15 | B |
| 35 | 0.2 | 0.55 | 0.25 | A |
| 36 | 0.2 | 0.45 | 0.35 | A |
| 37 | 0.2 | 0.35 | 0.45 | B |
| 38 | 0.2 | 0.2 | 0.6 | B |
| 39 | 0.2 | 0.1 | 0.7 | B |
| 40 | 0.1 | 0.85 | 0.05 | C |
| 41 | 0.1 | 0.7 | 0.2 | B |
| 42 | 0.1 | 0.45 | 0.45 | B |
| 43 | 0.1 | 0.2 | 0.7 | B |
| 44 | 0.1 | 0.05 | 0.85 | C |
| 45 | 0.03 | 0.8 | 0.17 | C |
| 46 | 0.03 | 0.5 | 0.47 | C |
| 47 | 0.03 | 0.17 | 0.8 | C |

Note

A: the shadows have excellent and balanced appearance;

B: the shadows are slightly inferior to those of A but have fairly good appearance;

C: the shadows are not good and have inferior balance in appearance.

When the rating is A or B, beautifully colored shadows are given, in practice, to attain beautiful illumination by using the method according to the present invention.

Figure 2:
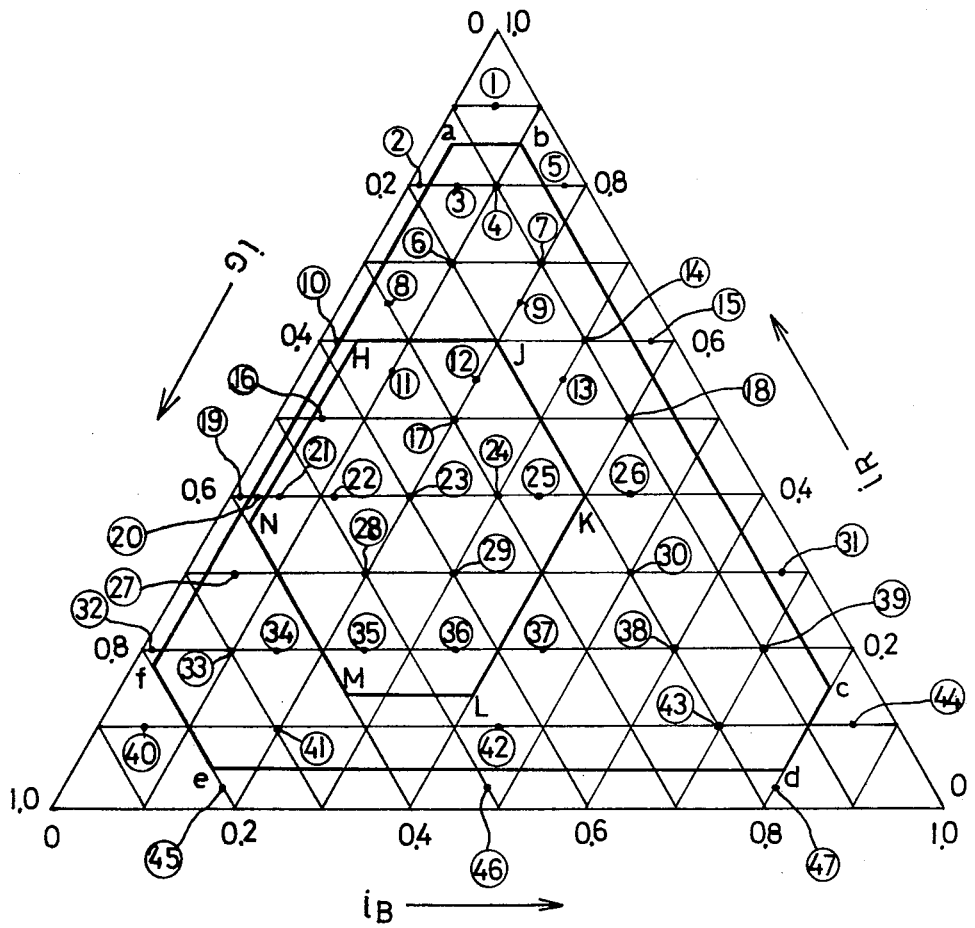
FIG. 2 is a triangular coordinate of the light intensity ratios for illustration of the invention.

The measured points of the marks ①,②,③, . . stated in Table 1 are shown in the triangular coordinate of FIG. 2.

In FIG. 2, the ratings A and B can be given in the range of the full line connecting the points of *a, b, c, d, e* and *f*, and the rating A can be given in the range of the full line connecting the points of H, J, K, L, M and N.

The coordinates of *a, b,* . . . and H, J, . . . in the triangular coordinate are shown in Table 2.

Table 2

| Mark | $i_R$ | $i_G$ | $i_B$ |
|---|---|---|---|
| a | 0.85 | 0.13 | 0.02 |
| b | 0.85 | 0.05 | 0.1 |
| c | 0.15 | 0.05 | 0.8 |
| d | 0.05 | 0.15 | 0.8 |
| e | 0.05 | 0.8 | 0.15 |
| f | 0.18 | 0.8 | 0.02 |
| H | 0.6 | 0.38 | 0.04 |
| J | 0.6 | 0.2 | 0.2 |
| K | 0.4 | 0.2 | 0.4 |

Table 2-continued

| Mark | $i_R$ | $i_G$ | $i_B$ |
|---|---|---|---|
| L | 0.15 | 0.45 | 0.4 |
| M | 0.15 | 0.6 | 0.25 |
| N | 0.36 | 0.6 | 0.04 |

In the embodiment, the intensity ratios $i_R$, $i_G$ and $i_B$ given by the color lamps in the R, G and B groups, were varied to evaluate the beauty of balance of the colored shadows.

When the intensity of illumination is highly changed under maintaining the ratios $i_R$, $i_G$ and $i_B$, the ratings of beauty and balance of the colored shadows are as shown in Table 3.

Table 3

| Mark | $i_R$ | $i_G$ | $i_B$ | $I_R$ | $I_G$ | $I_B$ | Rating |
|---|---|---|---|---|---|---|---|
| | | | | 35 | 10 | 5 | B |
| 6 | 0.7 | 0.2 | 0.1 | 70 | 20 | 10 | B |
| | | | | 700 | 200 | 100 | B |
| | | | | 3500 | 1000 | 500 | B |
| | | | | 15 | 9 | 6 | A |
| 17 | 0.5 | 0.3 | 0.2 | 75 | 45 | 30 | A |
| | | | | 750 | 450 | 300 | A |
| | | | | 3000 | 1800 | 1200 | A |
| | | | | 6 | 8 | 6 | A |
| 29 | 0.3 | 0.4 | 0.3 | 60 | 80 | 60 | A |
| | | | | 600 | 800 | 600 | A |
| | | | | 2400 | 3200 | 2400 | A |
| | | | | 6 | 6 | 18 | B |
| 38 | 0.2 | 0.2 | 0.6 | 36 | 36 | 108 | B |
| | | | | 180 | 180 | 540 | B |
| | | | | 720 | 720 | 2160 | B |

As it is clear from Table 3, the beauty of the colored shadows is not changed by highly changing the quantity of light given by the color lamps, that is the intensity of illumination, at the colored shadow of the substance when the intensity ratios $i_R$, $i_G$ and $i_B$ are constant.

Accordingly, in order to obtain beautifully colored shadows, it is necessary to maintain the intensity ratios $i_R$, $i_G$ and $i_B$ in the specific range surrounded by the full line connecting the points *a, b, c, d, e* and *f*, that is $$0.05 \leqq I_R/(I_R + I_G + I_B) \leqq 0.85;$$

$$0.05 \leqq I_G/(I_R + I_G + I_B) \leqq 0.8;$$

$$0.02 \leqq I_B/(I_R + I_G + I_B) \leqq 0.8.$$

It is especially preferable for attaining the object of the invention to maintain the intensity ratios in the range surrounded by the full line connecting the points H, J, K, L, M and N that is $$0.15 \leqq I_R/(I_R + I_G + I_B) \leqq 0.6,$$

$$0.02 \leqq I_G/(I_R + I_G + I_B) \leqq 0.6 \text{ and}$$

$$0.04 \leqq I_B/(I_R + I_G + I_B) \leqq 0.4,$$

whereby the optimum beautifully colored shadows can be obtained.

In the disclosed embodiment, the high pressure sodium lamp was used as the lamp in the R group and the green metal halide lamp (thallium halide is added) was used as the lamp in the G group and the blue metal halide lamp (indium halide is added) was used as the lamp in the B group, and the lamps are arranged on one lateral line in the order of R-B-G as shown in FIG. 1 and the objects 8, 9 are placed to give the colored shadows on the white wall 7.

Thus, similar effects can be attained by maintaining the intensity ratios $i_R$, $i_G$ and $i_B$ even though other desired color lamps in said groups are used.

The beautifully colored shadows can be also obtained by other arrangements such as B-G-R, G-R-B or reverse arrangements as well as the arrangement of R-B-G.

The order of arrangements of colored shadows 1 to 6 shown in FIG. 1 is changed depending upon the arrangement of the lamps.

The positions of the arranged lamps are not limited to a single line and can be desirably changed to be right and left, front and back, above and below depending upon the shape; size and place of the object and desired shadows and size of the colored shades.

When the color lamps, the object and the wall are independently or simultaneously moved, variations can be obtained by movement of the colored shadows.

The place for forming the colored shadows of the object caused by the color lamps, is not limited to a wall and can be any convenient place. If desirable, the place of the colored shadows can be illuminated by a white light lamp.

In any case, the beautifully colored shadows can be obtained and the unexpectedly marvelous effect can be attained by selecting the intensity ratios $i_R$, $i_G$ and $i_B$ from the range surrounded by the full line connecting the points *a, b, c, d, e,* and *f* in the triangular coordinate of FIG. 2.

Obviously, numerous additional modifications and variations of the present invention are patentable in light of the above teachings. It is therefore to be understood that within the scope of the appended claims, the invention may be practiced otherwise than as specifically described herein.

What is claimed as new and desired to be secured by letters patent in the United States is:

1. A method of mixing illumination from a plurality of sources for use in casting beautiful and balanced colored shadows of opaque objects which comprises the steps of:

arranging a plurality of color lamps in three groups including an R group of at least one lamp for emitting colored light in the range yellow to red, a G group of at least one lamp for emitting green light, and a B group of at least one lamp for emitting colored light in the range violet to blue; and irradiating a pair of opaque objects with colored light emitted by the color lamps in the three groups to cause colored shadows of the objects characterized by intensity ratios of illumination in the ranges of $$0.05 \leqq I_R/(I_R + I_G + I_B) \leqq 0.85;$$

$$0.05 \leqq I_G/(I_R + I_G + I_B) \leqq 0.8; \text{ and}$$

$$0.02 \leqq I_B/(I_R + I_G + I_B) \leqq 0.8$$

wherein $I_R$ designates an intensity of illumination caused by irradiating with only the lamp in the R group the shadow of one of the opaque objects cast by both of the lights of the lamps in the G group and the B group, $I_G$ designates an intensity of illumination caused by irradiating with only the lamp in the G group the shadow of the one of the opaque objects cast by both of the lights of the lamps in the R group and the B group, and $I_B$ designates an intensity of illumination caused by irradiating with only the lamp in the B group the combination of the shadow of the one of the opaque objects cast by the light of the lamp in the R group and the shadow of the other of the opaque objects cast by the light of the lamp in the G group.

2. A method of mixing illumination according to claim 1 wherein the intensity ratios of illumination lie in the range surrounded by the full line connecting the points *a, b, c, d, e* and *f* in the triangular coordinate diagram of FIG. 2 with each of the intensity ratios $I_R/(I_R + I_G + I_B)$, $I_G/(I_R + I_G + I_B)$ and $I_B/(I_R + I_G + I_B)$ being designated by $i_R$, $i_G$ and $i_B$ respectively.

3. A method of mixing illumination according to claim 1 wherein the intensity ratios of illumination lie in the range surrounded by the full line connecting the points H, J, K, L, M and N in the triangular coordinate diagram of FIG. 2 with each of the intensity ratios $I_R/(I_R + I_G + I_B)$, $I_G/(I_R + I_G + I_B)$ and $I_B/(I_R + I_G + I_B)$ being designated by $i_R$, $i_G$ and $i_B$ respectively.

4. A method of mixing illumination according to claim 1 wherein the arranging step comprises arranging color lamps in three groups including an R group consisting of a high pressure sodium lamp, a G group consisting of a green metal halide lamp and a B group consisting of a blue metal halide lamp.

5. A method of mixing illumination according to claim 1 including the step of moving the positions of the three groups of color lamps.

6. A method of mixing illumination according to claim 1 wherein the arranging step comprises arranging color lamps in three groups including an R group having a yellow color lamp, an orange color lamp, a red color lamp, a high pressure sodium lamp, an orange metal halide lamp and a red metal halide lamp, a G group having a green color lamp and a green metal halide lamp, and a B group having a violet color lamp, a blue color lamp, a violet metal halide lamp and a blue metal halide lamp.

* * * * *